US006893994B2

(12) United States Patent
Wallar

(10) Patent No.: US 6,893,994 B2
(45) Date of Patent: May 17, 2005

(54) PLASMA SPHEROIDIZED CERAMIC POWDER

(75) Inventor: Howard Wallar, Rutland, MA (US)

(73) Assignee: Saint-Gobain Ceramics & Plastics, Inc., Worcester, MA (US)

( * ) Notice: Subject to any disclaimer, the term of this patent is extended or adjusted under 35 U.S.C. 154(b) by 123 days.

(21) Appl. No.: 10/217,523

(22) Filed: Aug. 13, 2002

(65) Prior Publication Data

US 2004/0033884 A1 Feb. 19, 2004

(51) Int. Cl.[7] ..... C04B 35/48

(52) U.S. Cl. ..... 501/103; 501/104; 428/402; 264/402

(58) Field of Search ..... 501/103, 104; 428/402; 264/6

(56) References Cited

U.S. PATENT DOCUMENTS

| | | | | |
|---|---|---|---|---|
| 2,535,526 A | | 12/1950 | Ballard et al. | |
| 4,450,184 A | * | 5/1984 | Longo et al. | 427/453 |
| 4,590,090 A | | 5/1986 | Siemers et al. | |
| 5,885,547 A | * | 3/1999 | Gray | 424/1.37 |
| 6,022,594 A | * | 2/2000 | Borom et al. | 427/453 |
| 6,258,338 B1 | * | 7/2001 | Gray | 424/1.29 |
| 6,602,556 B2 | * | 8/2003 | Yu | 427/447 |

FOREIGN PATENT DOCUMENTS

| | | | |
|---|---|---|---|
| GB | 833 107 A | | 4/1960 |
| JP | 01-226732 A | | 9/1989 |
| JP | 401226732 | * | 9/1989 |
| JP | 11-335804 A | | 12/1989 |
| JP | 02-084016 A | | 3/1990 |
| WO | WO 02/45931 A1 | | 8/2002 |

OTHER PUBLICATIONS

T. Yano, et al., "Effects of Spray Pyrolysis Conditions On the Character Of Yttria–Partially Stablized Zarconia Powders", Yogyo Kyokaishi (1987), vol. 95, No. 1, pp. 111–16, Abstract Only, XP002265437.

A. Kato, et al., "8Interability of calcta–stabilized zirconia powders prepared by spray–pyrolysis technique retrieved from STN", Nippon Kagaku Kaishi (1983), vol. 10, pp. 1544–1546, Abstract Only, XP002265438.

K. Khor, et al., "Rapidly Solidified Naodymai–Stabilized Zirconia Coatings Prepared by DC Plasma Spraying", Surface and Coatings Technology, vol. 96 (1997), pp. 313–322.

* cited by examiner

*Primary Examiner*—Karl Group
(74) *Attorney, Agent, or Firm*—Joseph P. Sullivan

(57) ABSTRACT

Thermal spray powders suitable for application of a thermal barrier coating on a substrate can be obtained by plasma spraying a chemically homogeneous zirconia stabilized in the tetragonal form using a stabilizing oxide such as yttria to obtain a powder comprising substantially spherical hollow zirconia particles with sizes less than about 200 micrometers.

10 Claims, 5 Drawing Sheets

PLASMA SPHEROIDIZED CERAMIC POWDER

FIELD OF THE INVENTION

The present invention relates to ceramic powders, particularly zirconia powders, and a process for the production of ceramic powders in which the powders have a highly uniform composition.

BACKGROUND OF THE INVENTION

Stabilized zirconia powders are widely used to provide thermally stable and abrasion resistant coatings to parts that are exposed to very high temperatures during use but which are also exposed to ambient temperatures. It does, however, have a well-known drawback in that, as it cycles between high and low temperatures, it undergoes a crystal phase change from the tetragonal crystal phase structure, which is stable at elevated temperatures, to the monoclinic crystal phase structure, which is stable at room temperature. Volume changes occur as this crystal phase change takes place compromising the physical integrity of the zirconia coating. There is another phase of zirconia which is also stable at temperatures above the monoclinic/tetragonal transition temperature, (the "cubic" phase), but since little or no volume change occurs on the transition from cubic to tetragonal, this is treated for the purposes of this Description as a form of the tetragonal phase and is not distinguished therefrom.

In order to resolve the integrity problems with zirconia coatings resulting from the crystal phase changes, it is common to use stabilized zirconia in powder coatings. Stabilization can be achieved by the addition of a number of additives that have the effect of inhibiting the conversion from the tetragonal crystal phase to the monoclinic crystal phase upon cooling. Such additives include stabilizing oxides such as calcia, magnesia, yttria, ceria, hafnia, and rare earth metal oxides.

Stabilized zirconia coatings are widely used to produce an abradable protective coating on surfaces or thermal barrier coatings. They are typically applied as sprays by a flame spray or a plasma spray approach.

In the production of stabilized zirconia powders, the most common technique is described in U.S. Pat. No. 4,450,184 to Longo et al., in which an aqueous slurry comprising a blend of zirconia and stabilizer materials is fed into a spray dryer to form dried porous particles. The porous particles are fused into homogenous hollow structures with a plasma or flame spray gun which melts and fuses the components such that the particles ejected therefrom are stabilized zirconia. Thermal spraying of the hollow spheres creates a porous and abradable coating. However the Longo process does not achieve a high degree of uniformity of composition.

U.S. Pat. No. 5,418,015 to Jackson et al. discloses a feed composition for thermal spray applications composed of stabilized zirconia mixed with zircon and a selected oxide to form an amorphous refractory oxide coating. Such products do not however have the required level of size and compositional uniformity that would be desirable to secure good thermal barrier coating compositions for high temperature applications. This is at least in part because there are many opportunities for variability in the resultant coating as a result of differing particle sizes in the feed, the flame or plasma gun design/shape, feed rate pressures, and the like.

Another method of forming stabilized zirconia involves sintering wherein the components are blended together as powders, sintered, and upon cooling, the sintered mass is broken up into particles. These particles may then serve as feed for a flame spray device. Unfortunately, this process does not provide for a high level of chemical homogeneity in the stabilization and results in widely varying shapes and particle sizes in the feed.

Ceramic mixtures such as stabilized zirconia may also be made by electrofusion. The fused mixtures are much more uniform than those made by the processes discussed above because they are the result of complete melting of the components. However, the components are difficult to melt and have poor flow characteristics as a result of their high density and irregular shape generated when the fused masses are crushed to provide particles. Thus, the currently available stabilized zirconia powders made by electrofusion have a high degree of un-melted material in the spray process resulting in poor efficiencies and coatings with a high content of such un-melted material particles. The un-melted particles introduce stresses into the coating due to the varying density of the coating in and around the un-melted particles. As a result, the longevity of the resultant coating is diminished, particularly under stressful conditions.

Notwithstanding the state of the technology, it would be desirable to provide a ceramic powder having a high level of chemical and morphological uniformity, which in turn, provides a durable thermal spray coating.

SUMMARY OF THE INVENTION

In a first aspect, the present invention is directed to a zirconia powder particularly adapted for use as a thermal barrier coating which comprises morphologically and chemically uniform stabilized zirconia in the form of substantially spheroidal hollow spheres.

The zirconia is chemically uniform and by this meant that the zirconia is at least 90% pure and is at least about 96% by weight stabilized in a tetragonal crystal phase. The zirconia is also morphologically uniform and by this is mean that at least 95 volume % of the zirconia is in the form of spheres with a particle size of less than about 200 micrometers. The spheres may be somewhat deformed but are identifiably based on spheres rather than having random shapes. The spheres are preferably at least 75% hollow spheres. In a preferred embodiment a chemically uniform stabilized zirconia is heat treated by plasma fusion to obtain the substantially spheroidal shape. Preferably, the stabilized zirconia contains less than 1.0% by weight monoclinic zirconia.

In a preferred aspect, the present invention is directed to a thermally sprayable composition comprising hollow spheres of yttria stabilized zirconia, the hollow spheres having a particle size of less than about 200 micrometers, wherein the yttria is uniformly incorporated into the zirconia by electrofusion prior to formation of the hollow spheres. Preferably, the zirconia contains less than 2.0% by weight monoclinic zirconia. The hollow spheres are preferably formed by plasma fusion.

In yet another aspect, the present invention is directed to a process for producing spheroidized ceramic powder comprising the steps of: providing a chemically uniform, stabilized zirconia; and heat treating the zirconia to form substantially hollow spheres thereof of morphological uniformity. Preferably, the stabilized ceramic material comprises zirconia stabilized in a tetragonal crystal phase and contains less than about 2.0% by weight monoclinic zirconia. The stabilized zirconia is preferably formed by electrofusion of zirconia and a stabilizing oxide. Preferably, heat treating occurs in a plasma spray gun or a flame spray gun.

The process may further include the step of comminuting the stabilized ceramic materials prior to heat treating.

In still yet another aspect, the present invention is directed to a process of forming a thermal sprayable powder coating comprising the steps of: providing a zirconia feedstock wherein the zirconia is at least 96% by weight stabilized in a tetragonal crystal phase; and plasma fusing the zirconia feedstock to form substantially hollow spheres thereof. Preferably, the stabilized zirconia is formed by electrofusion.

The invention also comprises a process for the application of a thermal barrier coating to a substrate which comprises thermal spray coating the substrate using a sprayable composition comprising zirconia, of which at least 96% is stabilized in the tetragonal form, having a substantially uniform spherical morphology with particle sizes smaller than 200, and more preferably smaller than 100, micrometers. In referring to particle sizes it is understood that the reference is to volume average particle sizes unless otherwise apparent from the context

DETAILED DESCRIPTION OF THE PREFERRED EMBODIMENT

Figure 1:
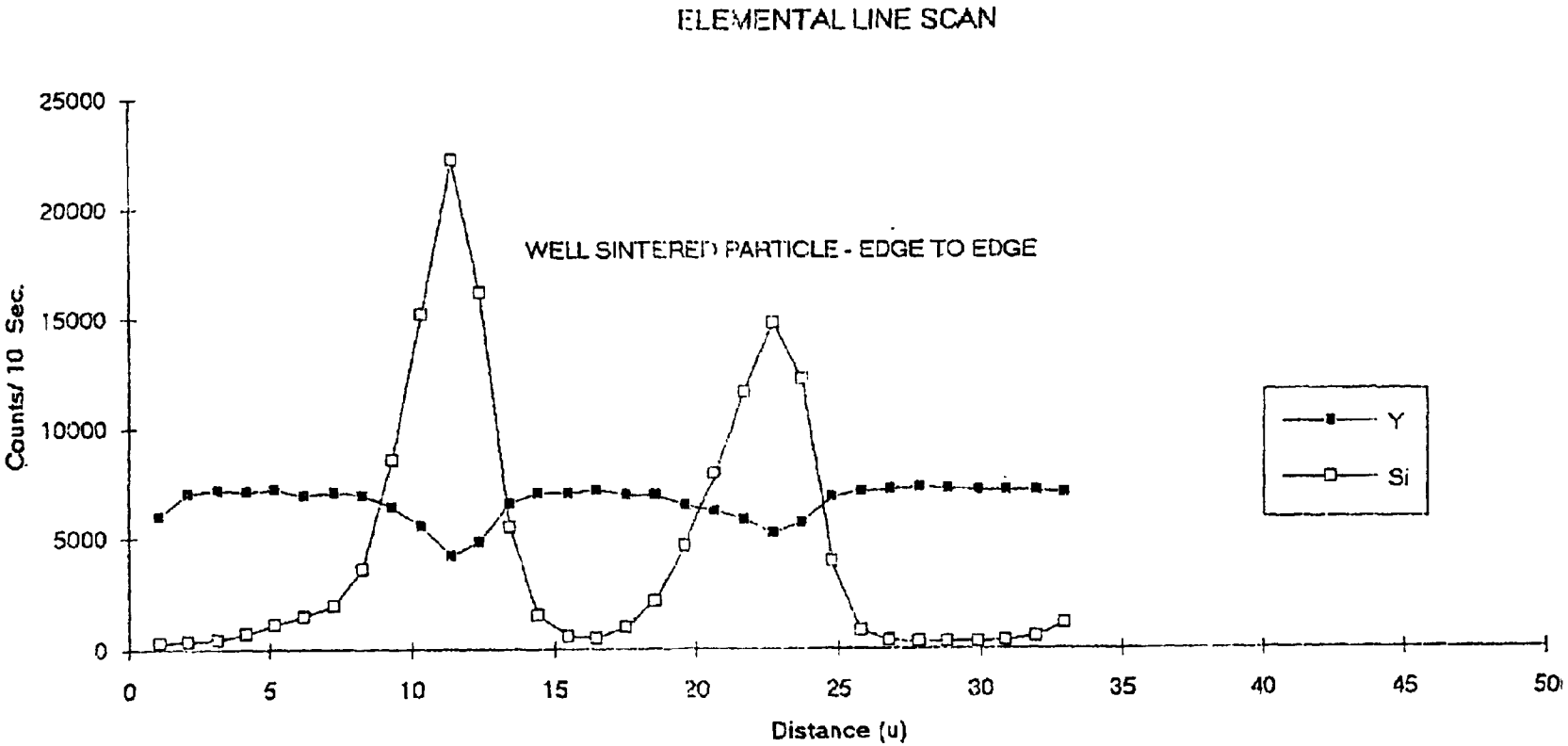
Figure 1 (Prior Art)
FIGS. 1 through 4 are elemental line scans of well sintered particles from commercially available stabilized zirconia powders.

The present invention is directed to a thermal sprayable zirconia powder having a very uniform chemical composition and morphology. The thermal sprayable ceramic powder preferably has a spheroidized shape, and even more preferably, the spheroidized particles are substantially hollow so that the particles melt more rapidly forming either dense coatings or coatings with uniform porosity depending on the spray conditions. In a most preferred embodiment, the thermal sprayable zirconia powder of the present invention comprises at least 90 volume % zirconia, and the zirconia is at least about 96% by weight stabilized in the tetragonal form by a stabilizing oxide. More preferably, the zirconia is at least 98% by weight stabilized in the tetragonal form, and most preferably, at least about 99% by weight stabilized in the tetragonal form.

The zirconia feedstock used in the present invention is stabilized with a stabilizing oxide such as, but not limited to, yttria, calcia, ceria, hafnia, magnesia, a rare earth metal oxide, and combinations thereof. To achieve a high chemical uniformity in the stabilized zirconia feedstock, the stabilizing oxide is preferably electrofused with the zirconia. The amount of stabilizing oxide used may vary depending on the result desired. A sufficient amount of the stabilizing oxide is an amount which substantially stabilizes the zirconia in the tetragonal crystal phase. The stabilizing oxide is desirably fully reacted with and incorporated into the zirconia crystal structure such that X-ray analysis cannot detect a significant amount, (no more than 4%), of the monoclinic zirconia. The amount of the stabilizing oxide present can be up to about 10% by weight but some stabilizers are effective at lower levels. For example, in the case of zirconia stabilized using yttria, an effective amount may be about 1% but can be as high as 20% by weight; for magnesia, about 2% to about 20% by weight is effective; for calcia, about 3% to about 5% by weight may be used; and for a rare earth metal oxide, about 1% to about 60% by weight. A mixture of stabilizing oxides may be used.

The stabilizing oxide, preferably yttria, is arc fused with the zirconia at a temperature range of about 2750° C. to about 2950° C. such that components are completely molten and, since this is above the transition temperature, the zirconia is substantially completely in the tetragonal crystal phase. Upon cooling to room temperature, the stabilizing oxide maintains this tetragonal state even below the normal transition temperature. To enhance this effect, the molten material is preferably rapidly cooled with water or air such that the melt flow is broken up into a flow of droplets and cooled to provide fine particles of stabilized zirconia with a very homogenous chemical composition. A method of quenching the molten zirconia and stabilizing oxide, where the rapid solidification tends to stabilize the tetragonal form of zirconia, is disclosed in U.S. Pat. No. 5,651,925, the entirety which is herein incorporated by reference. Preferably, the resulting fine particles of stabilized zirconia are further comminuted. Typically, the fine particles are milled to a size of less than about 5 microns, preferably less than about 2 microns, more preferably about 0.5 microns. The fine particles of stabilized zirconia are then preferably spray dried and collected as agglomerated particles. Although the agglomeration step is not essential to the practice of the invention, it does provide a more useable size for further heat treatment of the stabilized zirconia as discussed below.

The agglomerated particles are further heat treated to form substantially hollow spheres thereof having uniform morphology. A particularly preferred form of heat treatment is a plasma fusion process where the particles are melted together in a plasma flame and collected as a fine powder having a high level of chemical and morphological uniformity. Substantially hollow spheres of the stabilized zirconia are formed which preferably contain less than about 4% by weight, more preferably less than about 2% by weight, and more preferably less than about 1% by weight, monoclinic zirconia. Preferably, the substantially hollow spheres have a particle size of less than about 200 microns, more preferably less than about 100 microns, and most preferably, less than about 75 microns.

Unexpectedly, the substantially hollow spheres of the stabilized zirconia feedstock have a high level of chemical and morphological uniformity wherein the zirconia is at least about 96% by weight stabilized in the tetragonal crystal phase, preferably at least about 98% by weight stabilized in the tetragonal crystal phase, and more preferably at least about 99% by weight in the tetragonal crystal phase. Thus, thermal sprayable spheroidized powders of the present invention form more stable and durable coatings due to the high level of chemical uniformity due to the electrofusion of the zirconia and stabilizing oxide which substantially stabilizes the zirconia. The spheroidized particles of the stabilized zirconia melt more readily because of the hollow sphere morphology and complete reaction of the stabilizer with the zirconia. The coatings sprayed have very predictable density from high density to controlled porosity depending on the spray conditions.

To obtain durable zirconia thermal sprayable coatings, a uniform stabilization of the tetragonal crystal phase of the zirconia is crucial. It has now been shown that in comparison to commercially available zirconia powders stabilized with yttria, the spheroidized zirconia powder of the present invention shows substantial incorporation of the yttria into the zirconia. Table I illustrates an example of a zirconia powder of the present invention in comparison with commercially available stabilized zirconia powders with regard to volume percent of each crystal phase through X-ray Diffraction data (XRD).

TABLE I

| Ex. | Tet.* $ZrO_2$ (vol. %) | Mono. $ZrO_2$ (vol. %) | $Y_2O_3$ (vol. %) |
|---|---|---|---|
| PF | 100 | 0.0 | — |
| PX | 88.3 | 11.7 | — |
| ST | 98.9 | 1.1 | — |
| M1 | 95.6 | 4.4 | — |
| M2 | 89.4 | 10.6 | — |

*Includes cubic zirconia as well as tetragonal
PF = zirconia powder of the present invention.
PX = PRAXAIR ZRO ™ available from Praxair, Inc., Danbury, Connecticut.
ST = STARK YZ available from H.C. Stark GmbH.
M1 = METCO 204NS-G available from Sulzer Metco, The Coatings Co., Westbury, NY.
M2 = METCO 204 available from Sulzer Metco.

Figure 2:
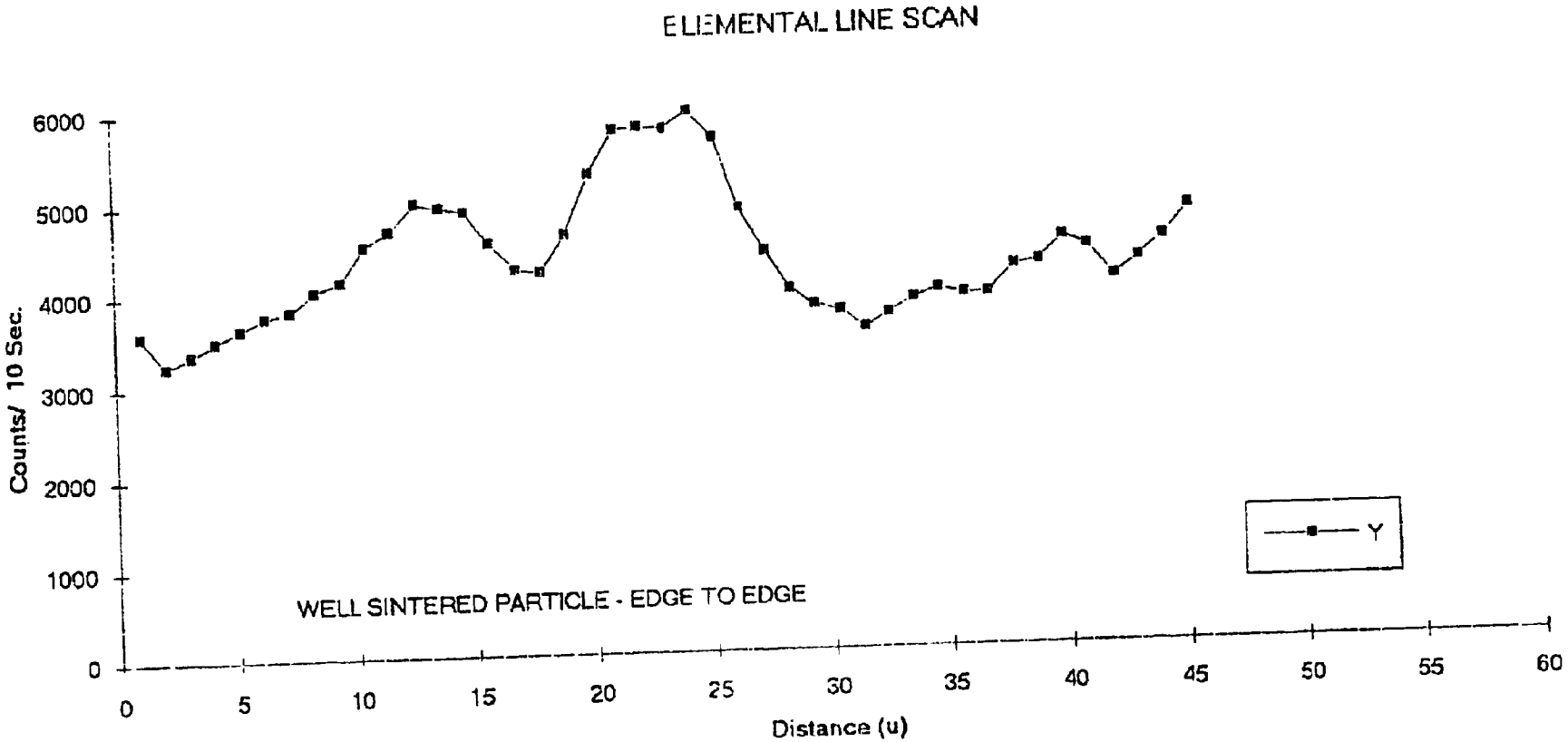
Figure 2 (Prior Art)
Figure 3:
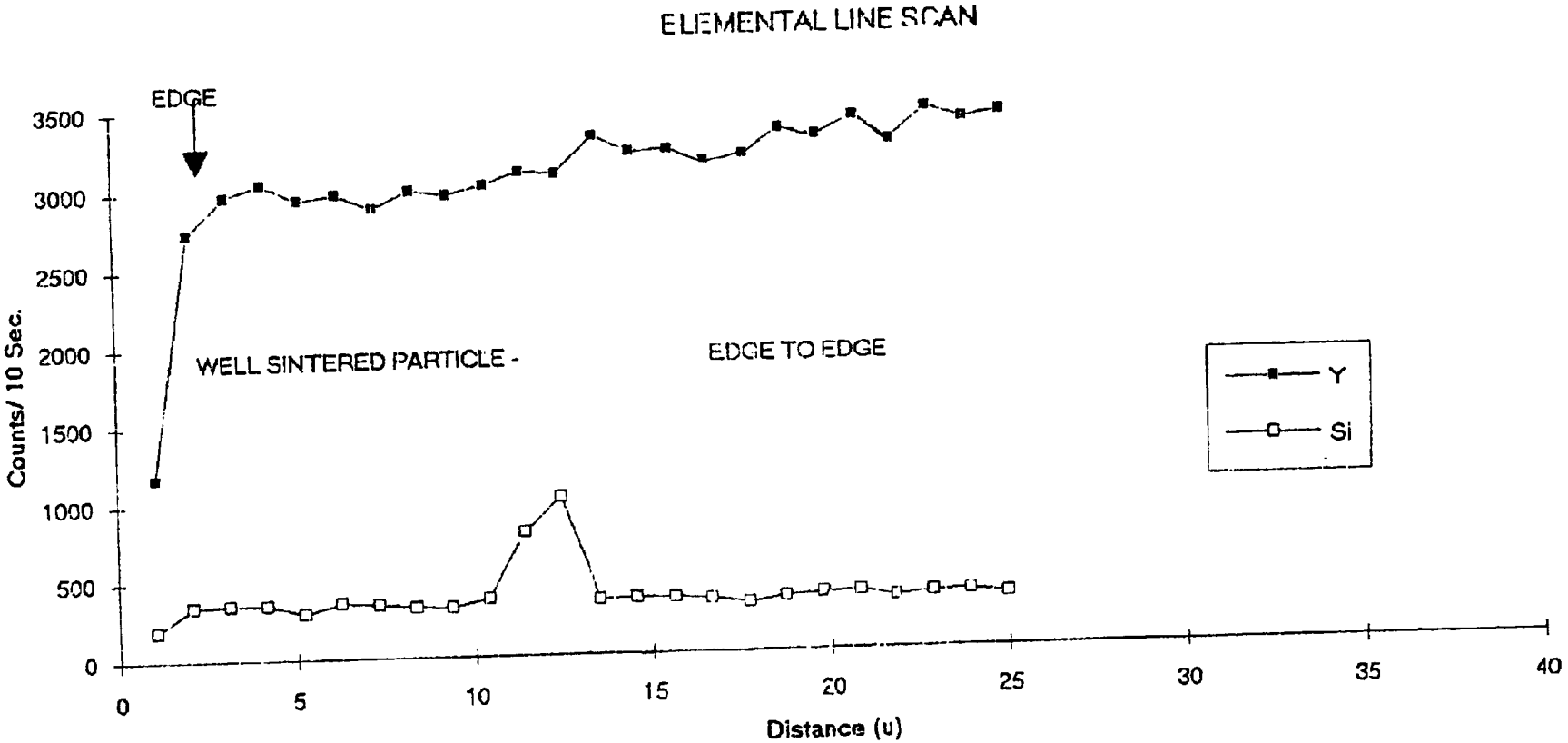
Figure 3 (Prior Art)
Figure 4:
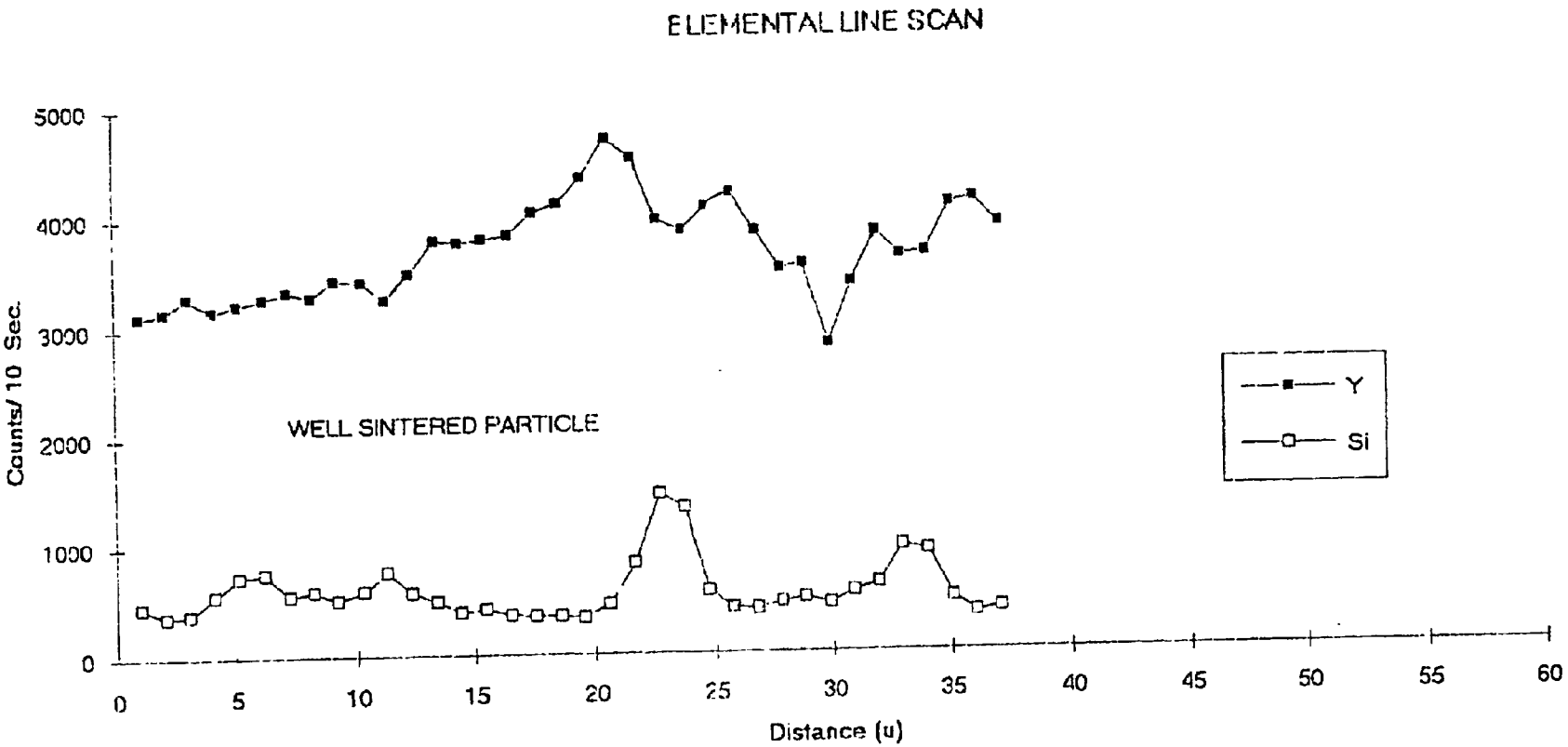
Figure 4 (Prior Art)

Although the concentration of yttria was not detected by X-ray diffraction (XRD) in all samples, it is the concentration of the monoclinic zirconia which determines whether the zirconia has been substantially stabilized in the tetragonal crystal phase. Elemental line scans of particles of Examples PX, ST, M1, and M2 are illustrated in FIGS. 1 through 4 to determine the composition of the particles. In FIG. 1, the elemental line scan, edge to edge, of a well-sintered particle of Example PX shows that the particle analyzed did not have a uniform composition given the non-linear line representing yttrium. Therefore, although XRD did not detect yttrium, the elemental line scan shows that the yttria did not completely co-fuse with the zirconia, and as such, the composition is not sufficienty chemically uniform. The spike in the silicon line further attests that the particle is also not chemically or morphologically uniform. In FIG. 2, the elemental line scan of a well-sintered particle of Example ST, edge to edge, also shows variations in the yttrium concentration, and thus, the particle is not chemically uniform. In FIG. 3, the elemental line scan of a well-sintered particle of Example M1, again shows variation in the yttrium concentration, and thus, the particle is not chemically uniform. In FIG. 4, the elemental line scan of a well-sintered particle of Example M2 again show variations in the yttrium concentration, and thus, the particle is not chemically uniform.

Figure 5:
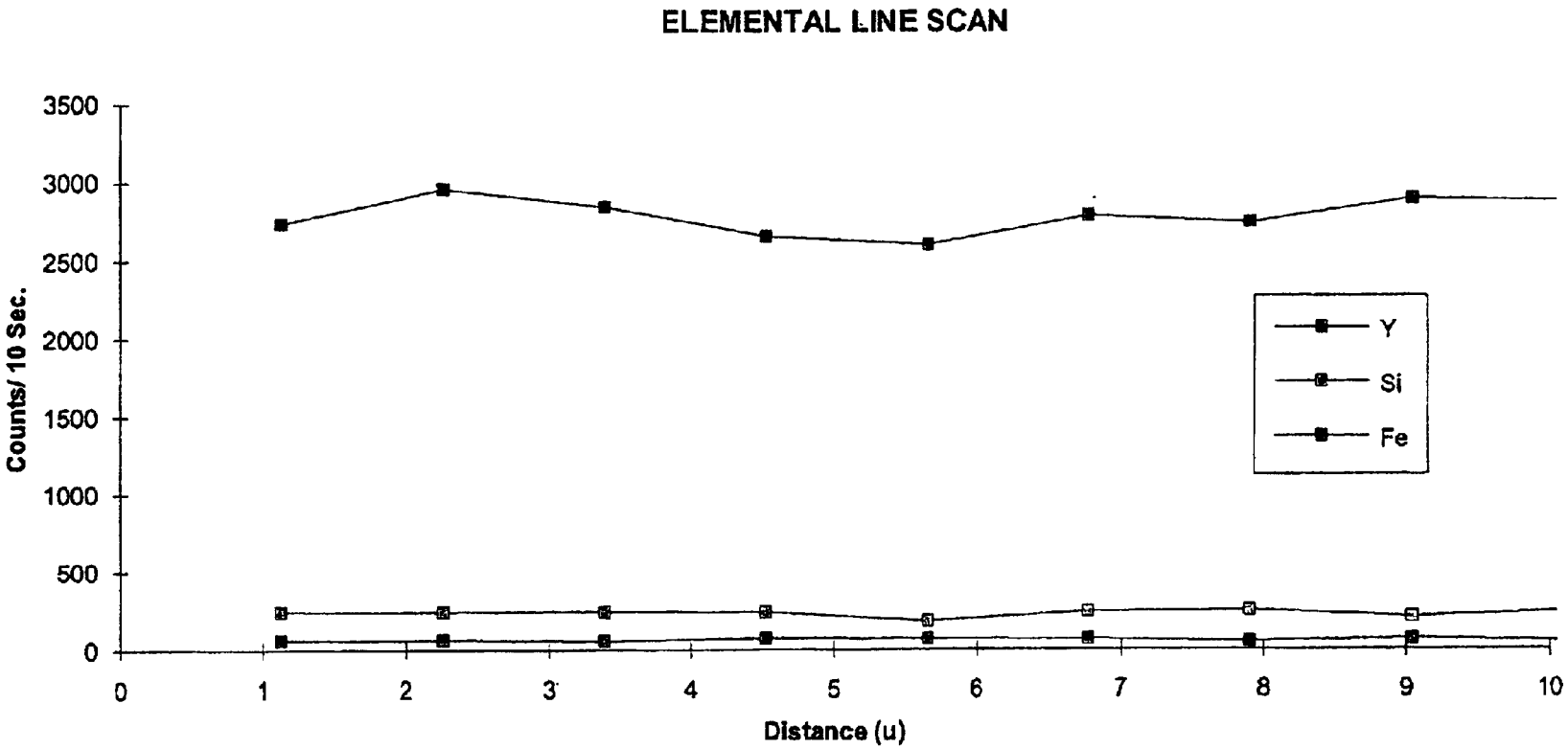
FIG. 5 is an elemental line scan of a hollow spheroidized zirconia particle made in accordance with the present invention.

By electrofusing the stabilizing oxide, yttria, with the zirconia, the stabilized zirconia is relatively uniform in composition. Further heat treatment such as plasma fusion provides the morphological uniformity of the substantially hollow spheres. The unexpected chemical and morphological uniformity is clearly illustrated in the elemental line scan shown in FIG. 5 of a hollow sphere of Example PF. The substantially linear yttrium line illustrates that a complete melt and re-solidification had occurred to provide a chemically uniform sphere. Also, the substantially flat silicon and iron element lines illustrate the morphological uniformity of the sphere.

Therefore, although the commercially available stabilized zirconia powders appear to be similar on their face, the spheroidized zirconia powder of the present invention provide a more chemically and morphologically uniform particle for thermal spray applications. The chemical and morphological uniformity in turn produces thermal spray coatings of exceptional durability.

Other variations and modifications of the basic invention can be conceived without departing from the concepts described above. It is intended that all such variations and modifications be included within the broad understanding of this invention.

What is claimed is:

1. Zirconia thermal spray powder comprising a chemically uniform stabilized zirconia wherein the zirconia is at least about 96% by weight stabilized in the tetragonal crystal phase, said powder being in the form of substantially spherical particles having a particle size of less than 200 micrometers, at least the majority of said particles being hollow.

2. The zirconia powder of claim 1 wherein said hollow particles have a particle size of less than about 100 microns.

3. The zirconia powder of claim 1 wherein the zirconia is stabilized with an oxide selected from the group consisting of yttria, magnesia, calcia, ceria, hafnia, a rare earth oxide, and combinations thereof.

4. The zirconia powder of claim 1 which contains less than 1.0% by weight monoclinic zirconia.

5. A process for the production of a chemically uniform thermal spray powder which comprises the steps of:

a) electrofusing zirconia with up to 60% by weight of an oxide effective to stabilize the zirconia in the tetragonal phase;

b) quenching the electrofused stabilized zirconia to obtain particulate stabilized zirconia with at least 96% of the zirconia in the tetragonal phase;

c) heat treating the stabilized zirconia to form substantially spherical hollow particles of stabilized zirconia with particle sizes of 200 micrometers or less.

6. A process according to claim 5 in which the zirconia is stabilized in the tetragonal form using tip to 60% by weight of a stabilizing oxide selected from the group consisting of yttria, rate earth metal oxide, calcium oxide and magnesium oxide.

7. A process according to claim 5 in which the stabilizing oxide is yttria in an amount of from 1 to 25% by weight.

8. A process according to claim 5 in which the quenched stabilized zirconia is at least 98% in the tetragonal phase.

9. A process according to claim 5 in which particulate stabilized zirconia is plasma sprayed to yield substantially spherical particles at least the majority of which are hollow with particle sizes below 100 micrometers.

10. The zirconia powder of claim 1, wherein the powder is formed through electrofusion.

* * * * *